US005927887A

United States Patent [19]

Ishikawa et al.

[11] Patent Number: 5,927,887

[45] Date of Patent: Jul. 27, 1999

[54] CAP FOR A WRITING MEANS

[75] Inventors: Shinichi Ishikawa; Makoto Nishimura, both of Tokyo, Japan

[73] Assignee: Zebra Co., Ltd., Tokyo, Japan

[21] Appl. No.: 08/780,186

[22] Filed: Dec. 26, 1996

[30] Foreign Application Priority Data

Nov. 26, 1996 [JP] Japan ..... 8-315162

[51] Int. Cl.[6] ..... B43K 5/00

[52] U.S. Cl. ..... 401/202; 401/243

[58] Field of Search ..... 401/202, 213, 401/243, 247

[56] References Cited

U.S. PATENT DOCUMENTS

| | | |
|---|---|---|
| 4,765,767 | 8/1988 | Marynissen et al. . |
| 5,000,603 | 3/1991 | Isoda . |
| 5,000,604 | 3/1991 | Isoda . |
| 5,051,015 | 9/1991 | Moeck . |
| 5,066,156 | 11/1991 | Petrillo . |
| 5,076,721 | 12/1991 | Belmondo . |
| 5,127,754 | 7/1992 | Mase . |
| 5,176,460 | 1/1993 | Garry . |
| 5,186,564 | 2/1993 | Fuhrmann, III et al. . |
| 5,203,637 | 4/1993 | Nishimura et al. . |

FOREIGN PATENT DOCUMENTS

| | | | |
|---|---|---|---|
| 36 41 389 | 1/1988 | Germany | 401/202 |
| 3817248 | 10/1989 | Germany . | |
| 9111419 | 1/1992 | Germany . | |
| 1117111 | 10/1989 | Japan . | |
| 2-58981 | 4/1990 | Japan . | |
| 4085095 | 3/1992 | Japan . | |
| 2512102 | 10/1992 | Japan . | |
| 2220199 | 1/1990 | United Kingdom . | |
| 2229967 | 10/1990 | United Kingdom . | |
| 91/14582 | 10/1991 | WIPO . | |
| 93/09960 | 5/1993 | WIPO . | |

*Primary Examiner*—David J. Walczak
*Attorney, Agent, or Firm*—Greenblum & Bernstein P.L.C.

[57] ABSTRACT

A cap for a writing instrument is provided with a suffocation preventive construction. Thus, if a curious child or the like should accidentally swallow the cap and the cap lodges in the child's throat or bronchus, a sufficient flow of air is provided to avoid suffocation. Particularly, a cap for a writing implement of a double-tube construction is provided with an air communicating portion positioned in an inner peripheral surface of an outer tube having open front and rear portions. An inner tube having a closed end is held coaxially within the outer tube, and a predetermined clearance is provided to enable communication between the air communicating portion, defined by space between the outer tube and the inner tube, and a front-end opening of the outer tube. The predetermined clearance is provided between an inclined lower end of a tapered portion provided in a front-end opening of the inner tube and the inner peripheral surface of the outer tube, whereby the permeability of the cap is not impaired by ink adhered to the tapered portion during the process of mounting of the cap to the axial tube of the writing implement.

13 Claims, 4 Drawing Sheets

CAP FOR A WRITING MEANS

BACKGROUND OF THE INVENTION

1. Field of the Invention

This invention relates to a cap for a writing instrument, and particularly to a cap of a double-tube construction in which an air communicating portion is secured in an inner peripheral surface of an outer tube having front and rear open portions, a closed-end tubular inner tube is held coaxially within the outer tube. Thus, a permeable cap provided with a suffocation preventive construction in which even if a curious child or the like should accidentally swallow and lodge the cap in its throat or bronchus, a sufficient flow of air is provided to avoid suffocation.

2. Description of Prior Art

In the past, a cap for a writing instrument of a double construction has been known which comprises an outer tube having front and rear open portion and a closed-end tubular inner tube which is held coaxially within the outer tube such that an air communicating portion is provided in an inner peripheral surface of the outer tube and which is in contact with an outer peripheral surface of a front-portion of an axial tube from which a pen body projects when the cap mounted to the axial tube to seal the pen body. The cap includes a tapered portion that guides the pen body into the inner tube during the mounting process to the axial tube (disclosed, for example, in Japanese Utility Model Laid-Open Nos. Hei 2-58981 and 4-117790).

For example, the conventional cap disclosed in the aforementioned Japanese Utility Model Laid-Open No. Hei 4-117790 is constructed such that an outer tube and an inner tube are integrally connected at a bridge portion so that the inner tube is held coaxially within the outer tube, a front surface of the bridge portion facing a front-end opening side of the outer tube comprises a taper portion that is enlarged and inclined from a front-end opening of the inner tube toward the front-end opening side of the outer tube. A pen body is guided into the inner tube by the tapered portion when the cap is mounted to an axial tube. The bridge portion provided with the taper portion is peripherally provided with several vent holes extending through the air communicating portion from the taper portion to provide a permeable cap in which the rear-end opening side and the front-end opening side of the outer tube are in communication, Thus, even if a child or the like should accidentally swallow the cap and lodge the same in its throat or bronchus, suffocation can be avoided by communication of air from the rear-end opening side to the front-end opening side or from the front-end opening side to the rear-end opening side of the outer tube by providing air through the air communicating portion and several vent holes provided in the bridge portion.

The taper portion of the bridge portion that integrally connects and holds the outer tube and the inner tube guides and leads the pen body into the inner tube, as mentioned above, while contacting the pen body to the axial tube. Therefore, during a guiding of the pen body into the inner tube, ink tends to be adhere to the taper portion, such adhesion being unavoidable. Accordingly, in the past, the ink adhered to the taper portion is likely to flow into the vent holes of the bridge portion from the taper portion toward the air communicating portion and becomes solidified therein to close the vent holes. That is, permeability of the cap can be impeded.

OBJECT AND SUMMARY OF THE INVENTION

It is an object of the present invention to provide a cap of a double-tube construction in which an air communicating portion is provided between an outer tube having front and rear open portions and a closed-end tubular inner tube, which is not closed by ink and can be positively maintained.

A further object of the present invention is to avoid in advance a dangerousness caused by elongated foreign matter, and permeability is not impeded by entry the elongated foreign matter.

Other objects will become apparent from the ensuing detailed description and drawings.

These objects are achieved by a cap for a writing instrument provided by the present invention.

According to the present invention, there is provided a cap of a double-tube construction for a writing instrument in which in a state where an air communicating portion is secured in an inner peripheral surface of a tubular outer tube having front and rear portions opened, a closed-end tubular inner tube is held coaxially within the outer tube, wherein a predetermined clearance for communication between an air communicating portion between the outer tube and the inner tube and a front-end opening side of the outer tube is provided between an inclined lower end of a taper portion enlarged and inclined from the front-end opening of the inner tube toward the inner peripheral surface and toward the front-end opening of the outer tube.

The taper portion is provided at the inclined lower end with a liquid stopping flat portion having a suitable annular width capable of enlarging a spacing relative to the clearance for communication between the air communicating portion and the front-end opening side of the outer tube.

The air communicating portion is formed to be a substantially crank configuration in longitudinal section comprising a rear-side communicating portion provided coaxially and annularly in the inner tube in a suitable range from a closed rear end surface of the inner tube toward a front-end opening side thereof and a front-side communicating portion provided between the inner tube and the outer tube peripherally bent and communicated with the rear-side communicating portion in the range from the rear-side communicating portion to the front-end opening of the inner tube. Further, the rear-end communicating portion comprises a first communicating portion positioned to be opened to the rear-end surface of the inner tube and opened coaxially and annularly in a suitable range toward the front-end opening side of the inner tube, and a second communicating portion opened to be communicated coaxially and annularly from the first communicating portion toward the front-side communicating portion, peripherally bent and communicated with the front-side communicating portion, and peripherally defined by connecting longitudinal ribs provided peripherally several in number.

The inner tube is provided at the rear-end surface outer peripheral edge thereof with a large-diameter collar portion in contact with and stopped at the rear-end opening end surface, and the outside diameter of the inner tube in a suitable range in which the rear-side communicating portion is opened from the large-diameter collar portion is formed to have the size capable of being fitted into the outer tube.

Further, a stopping convex portion is provided at an outer peripheral surface part from the large-diameter collar portion in contact with and stopped at the rear end opening end surface of the outer tube toward the front-end opening side of the inner tube in a suitable range, and a stopping shoulder for stopping said stopping convex portion is provided at the inner peripheral surface part from the rear-end opening of the outer tube toward the front-end opening side in the suitable range.

Furthermore, there is provided a longitudinal rib integrally extended from peripheral several connecting longitudinal ribs for peripherally defining the second communicating portion of the rear-side communicating portion, on the outer peripheral surface in the range toward the vicinity of an annular convex portion in close contact with the fore-portion outer peripheral surface of an axial tube from which a pen body projects when mounted to the axial tube provided on the inner peripheral surface of the front-end opening of the inner tube.

DETAILED DESCRIPTION OF PREFERRED EMBODIMENTS

The preferred embodiments of the present invention will be described below with reference to the drawings.

Figure 1:
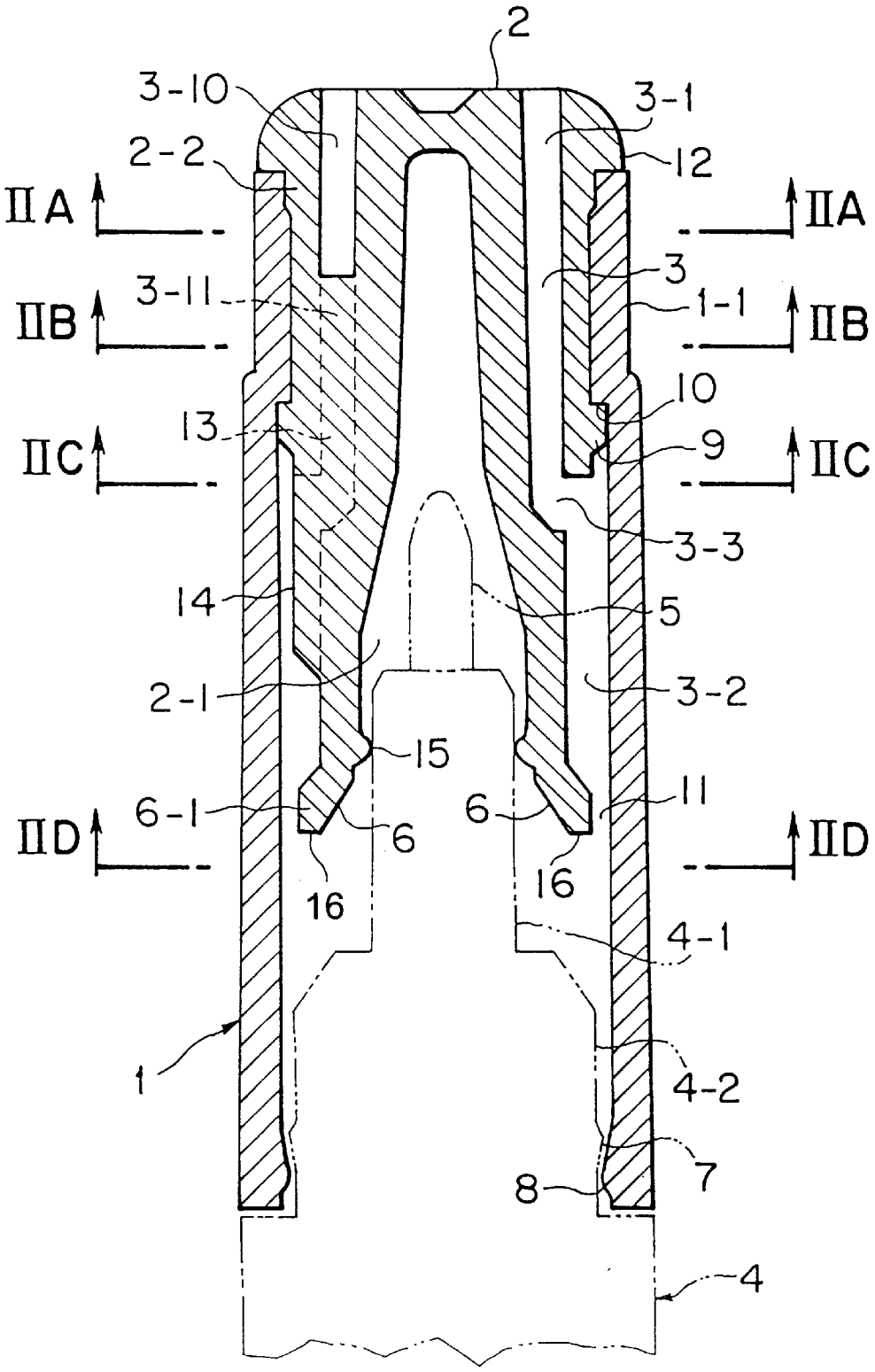
FIG. 1 is a longitudinal sectional view showing one example of an embodiment of a cap for a writing means according to the present invention.

FIG. 1 is a longitudinal sectional view of a cap according to the present invention showing one example of the embodiment, which has a double-tube construction in which a closed-end tubular inner tube 2 is held coaxially within an outer tube 1 having front and rear open portions such that an air communicating portion 3 is secured between the inner tube 2 and the outer tube 1, the front-end opening of the inner tube 2 is provided with a taper portion 6 for guiding a pen body 5 projecting from a front-portion 4-1 of an axial tube 4 into the inner tube when the cap mounting to the axial tube 4.

The outer tube 1 is formed of a desired injection molding material such as synthetic resin and is in the form of a cylindrical tube having a predetermined length whose inside diameter is substantially the same as the outside diameter of a mounting portion 4-2 of the axial tube 4 and whose front and rear open portions have substantially constant wall thickness over the full length thereof. The rear-end opening is provided with a holding portion 1-1 for fitting and holding the inner tube 2 coaxially. The front-end opening is provided at its inner peripheral surface with an annular stop portion 8 to be fitted over an annular fitting portion 7 of the mounting portion 4-2 of the axial tube 4.

The holding portion 1-1 is formed by providing, in a suitable axial range, from the rear- opening end of the outer tube 1 toward the front-end opening thereof, a portion smaller in both inside and outside diameters than other portions, and a stop shoulder 10 for stopping a convex stop portion 9 (described later) of the inner tube 2 is provided in the inner peripheral surface edge located on the front-end opening side.

The inner tube 2 is likewise formed of a desired injection molding material such as synthetic resin and is in the form of a closed-end tube whose entire external shape is formed to be smaller than the inside diameter of the outer tube 1 and in which an inner hole 2-1 for receiving the pen body 5 therein in a sealing fashion is formed to became smaller toward an inner bottom portion so as to gradually close from the front-end opening toward the inner bottom portion while providing an area in which the pen body 5 of the axial tube 4 is fitted, and comes in close contact with the projecting front-portion 4-1. That is, there is provided a closed-end tube in which the wall thickness of the front-end opening, which is in contact with the outer peripheral surface of the front-portion 4-1 of the axial tube 4, is formed to be fitted and in contact under slight elastic force when fitted to the front-portion 4-1. The wall thickness gradually thickens from the front-end opening part toward the closed rear end and the length thereof is about half of the full length of the outer tube 1. A taper portion 6 enlarged and inclined toward the inner peripheral surface of the outer tube 1 and toward the front-end opening of the outer tube 1 is provided at the front-end opening. The inner tube is incorporated and fitted in the holding portion 1-1 of the outer tube 1 so that the former is coaxially held within the outer tube 1 so as to secure a required annular clearance 11 for connecting the air communicating portion 3 and the front-end opening of the outer tube 1 between the inner peripheral surface of the outer tube 1 and the inclined lower end of the taper portion 6. The inner tube 2 is provided at the outer peripheral edge of the rear end thereof with a large-diameter collar portion 12 in contact with and stopped at the rear-opening end of the outer tube 1 and at the inner peripheral surface of the front-end opening with an annular convex portion 15 in close contact with the outer peripheral surface of the front-portion 4-1 of the axial tube 4 when mounted.

The large-diameter collar portion 12 has a serves to cooperate with the convex stop portion 9 of the outer peripheral surface of the inner cylinder 2 fitted in and stopped at the stop shoulder 10 provided with an inner peripheral surface edge of the holding portion 1-1 to hold the holding portion 1-1 so as to retain it in an axial direction and to fixedly hold the inner tube 2 within the outer tube 1 in an axially immovable state. The collar portion is provided on the outer peripheral edge of the rear-end surface of the inner tube 2 so as to have a projecting outside diameter which is substantially the same as the outside diameter of the rear-end opening of the outer tube 1. The convex stop portion 9 stopped at the stop shoulder 10 of the holding portion 1-1 is provided at the outer peripheral surface spaced from the large-diameter collar portion 12 toward the front-end opening of the inner tube 2 by a distance in the range of axial length of the holding portion 1-1.

The air communicating portion 3 is of a suffocation preventive construction in which the closed rear end portion of the inner tube 2 is communicated with the front-end opening of the outer tube 1 through an open sectional area through which air fully flows to sufficiently secure a flow of air, even if a curious child or the like should swallow accidentally to be stopped at its throat or bronchus, to sufficiently secure the flow of air to avoid suffocation, and has a substantially crank-like configuration in longitudinal section comprising a rear-side communicating portion 3-1 provided coaxially and annularly in the inner tube 2 in a suitable range from the closed rear end surface of the inner tube 2 toward the front-end opening, and a front-side communicating portion 3-2 provided between the inner tube 2 and the outer tube 1 in the range from the rear-side communicating portion 3-1 to the front-end opening of the inner tube 2 and bent and communicated in the peripheral direction from the rear-side communicating portion 3-1 (see FIG. 1).

The rear-side communicating portion 3-1 is provided with a coaxial annular opening at the latter half of full length of the inner tube 2 from the rear end surface of the inner tube 2 toward the front-end opening, in which a first communicating portion 3-10 opened in a suitable range from the rear end surface of the inner tube 2 and a second communicating portion 3-11 communicated and opened from the first communicating portion 3-10 toward the front-side communicating portion 3-2, bent and communicated in a peripheral direction through the front-side communicating portion 3-2 and a bent communicating portion 3-3 and defined in a peripheral direction by means of connecting longitudinal ribs 13 provided at several locations in a peripheral direction are opened coaxially annularly within the wall of the inner tube 2.

Figure 2A:
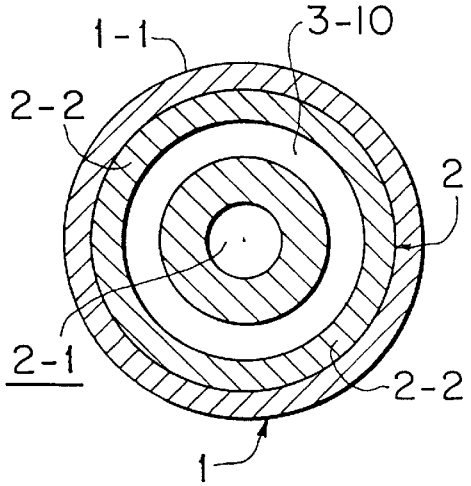
FIG. 2A is a cross-sectional view taken along line A—A of FIG. 1.

The first communicating portion 3-10 is opened coaxially annularly in the range (length) of about half of the full length of the rear-side communicating portion 3-1 from the rear end surface of the inner tube 2 (see FIG. 1 and FIG. 2A) and comprises an air inlet or outlet if the throat or bronchus should be stopped, and further, when the inner tube 2 is incorporated and fitted in the holding portion 1-1 of the outer tube 1 and held coaxially within the outer tube 1, absorbs and relieves a load stress (internal stress) caused by a dimensional error relative to the inner tube 2 so as not to apply the load stress to the rear-end opening of the outer tube 1 as the holding portion 1-1. That is, in the case where a dimensional error caused by molding occurs in which an unnatural condition occurs during incorporation and fitting into the holding portion 1-1 because the inside diameter of the holding portion 1-1 is slightly smaller than the outside diameter of the outer annular portion 2-2 of the inner tube 2 provided with the large-diameter collar portion 12 annularly divided by the first communicating portion 3-10 and the outside diameter of the outer annular portion 2-2 is slightly larger than the inside diameter of the holding portion 1-1, the load stress caused by the dimensional error is absorbed and relieved by an escape (elastic deformation) of the outer annular portion 2-2 toward the first communicating portion 3-10 side whereby a damage such as a crack caused by the load stress from the open end edge is not imparted to the rear-end opening of the outer tube 1, and the inner tube 2 can be incorporated and fitted into the holding portion 1-1 and fixedly held positively within the outer tube 1.

Figure 2B:
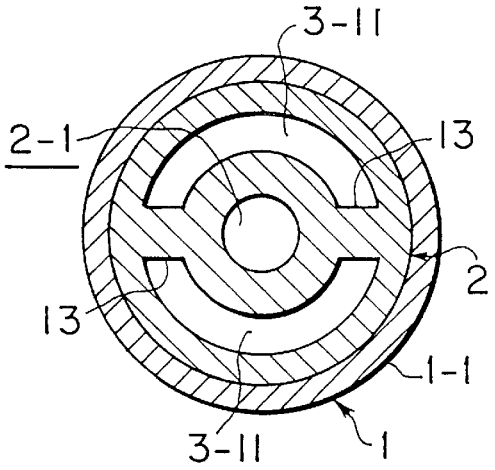
FIG. 2B is a cross-sectional view taken along line B—B of FIG. 1.

On the other hand, the second communicating portion 3-11 is opened coaxially and annularly likewise the first communicating portion 3-10 in the range (length) of communication through the front-side communicating portion 3-2 and the peripheral bent communicating portion 3-3 over the front-side communication portion 3-2 from the first communicating portion 3-10, and defined peripherally by means of two connecting longitudinal ribs 13 opposedly provided on the circumference thereof to communicate the first communicating portion 3-10 with the front-side communicating portion 3-2 (see FIG. 1 and FIG. 2B).

The front-side communicating portion 3-2 is provided with a required open sectional area between the outer peripheral surface in the first half side of the full length of the inner tube 2 leading to the front-end opening of the inner tube 2 in communication through the bent communicating portion 3-3 bent at a substantially right angle to the outward peripheral direction from the second communicating portion 3-11 of the rear-side communicating portion 3-1 and the inner peripheral surface of the outer tube 1 so that if the throat or bronchus should be stopped, air having flown through the clearance 11 between the inclined lower end of the taper portion 6 and the inner peripheral surface of the outer tube 1 is led to the rear-side communicating portion 3-1 through the bent communicating portion 3-3 and air having flown through the bent communicating portion 3-3 from the rear-side communicating portion 3-1 is led to the front-end opening side of the outer tube 1 through the clearance 11.

Figure 2C:
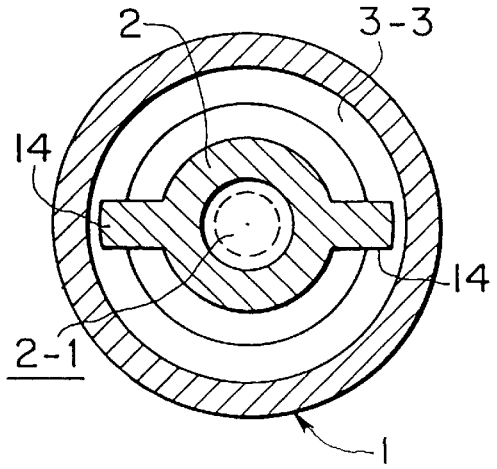
FIG. 2C is a cross-sectional view taken along line C—C of FIG. 1.

In the drawings, the reference numeral 14 designates a longitudinal rib provided in the outer peripheral surface of the front-end opening of the inner tube 2 to secure the front-side communicating portion 3-2 relative to the inner peripheral surface of the outer tube 1. The longitudinal rib 14 is integrally extended to the outer peripheral surface of the inner tube 2 in the range from the respective connecting longitudinal ribs 13 for peripherally defining the second communicating portion 3-11 of the rear-side communicating portion 3-1 toward the annular convex portion 15 of the inner peripheral surface of the inner tube 2 (see FIG. 1 and FIG. 2C) to maintain constant over a long period of time the enlarged elastic deformation state of the inner tube 2 slightly subjected to enlarged elastic deformation during the process placed in close contact and fitted along the outer peripheral surface of the front-portion 4-1 from which the pen body 5 is projected when mounted to the axial tube 1. That is, the longitudinal rib 14 can prevent, from the outer peripheral surface, the a reduction in the elasticity of the inner tube 2 which can occurs due to the repetitious enlarged elastic deformation which occurs during every mounting and removal of the cap from the axial tube 1. Thus, the inner tube 2 can be always placed in close contact and fitted in the fore-portion 4-1 with high air-tightness required in preventing volatilization of ink from the pen body 5 to be sealed.

Figure 2D:
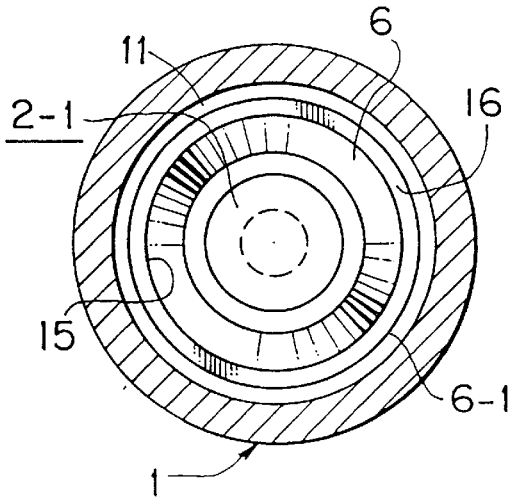
FIG. 2D is a cross-sectional view taken along line D—D of FIG. 1.
Figure 3A:
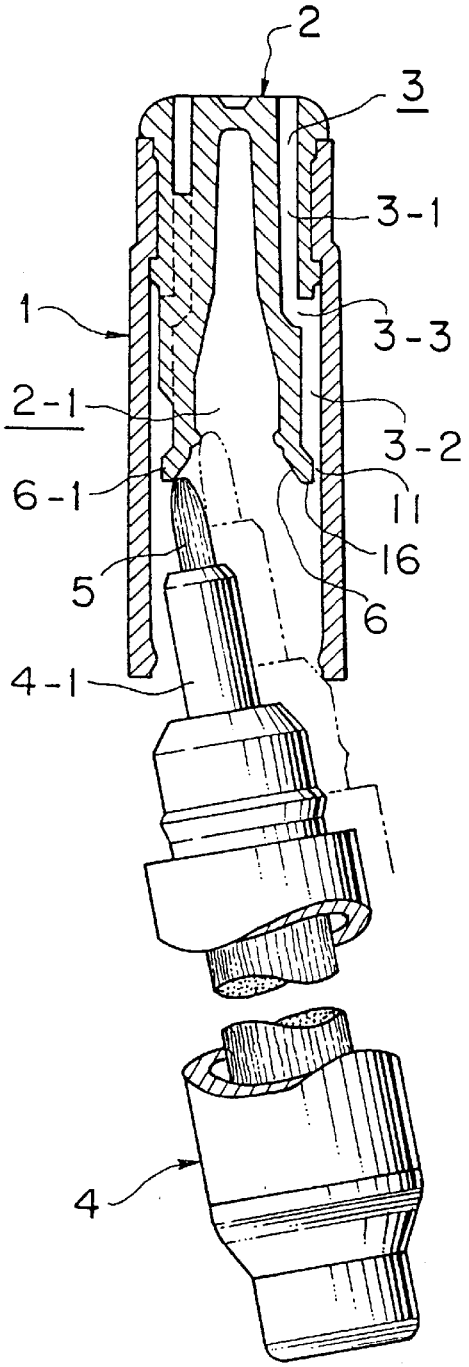
FIG. 3A is a longitudinal sectional view showing the mounting process with respect to an axial tube with a part of the axial tube omitted.
Figure 3B:
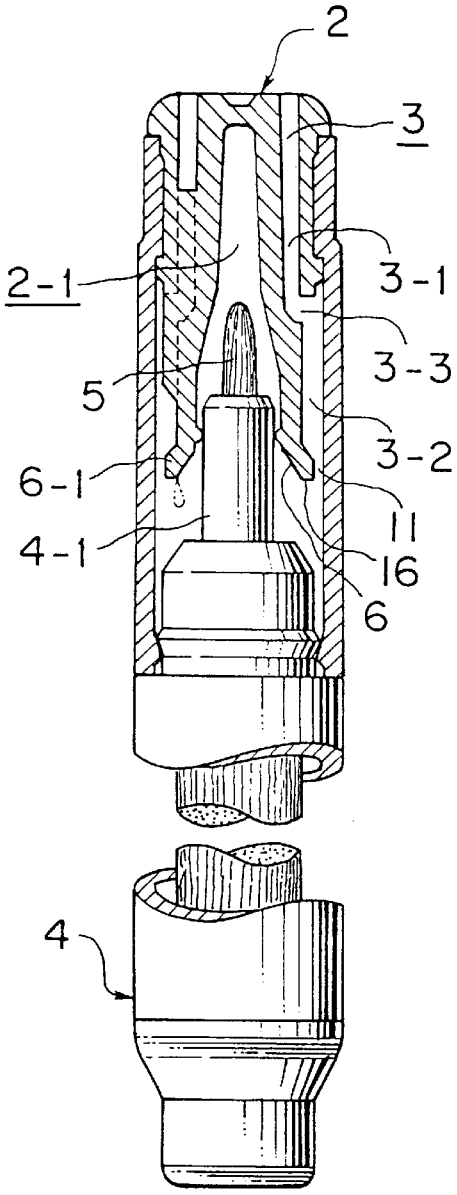
FIG. 3B is a longitudinal sectional view showing the state in which the cap is mounted on the axial tube.

The taper portion 6 is provided in the inclined inner peripheral surface of an annular inclined edge portion 6-1 enlarged and inclined toward the inner peripheral surface of the outer tube 1 from the front-end opening of the inner tube 2 and toward the front-end opening of the outer tube 1 (see FIG. 1 and FIG. 2D) so that when mounting to the outer tube 1, the pen body 5 is guided to the inner hole 2-1 of the inner tube 2 while contacting therewith during the mounting process (the state of FIG. 3A to the state of FIG. 3B). The annular inclined edge portion 6-1 is integrally enlarged and projected at a suitable inclined angle from the front-end opening of the inner tube 2 toward the vicinity of the inner peripheral surface of the outer tube 1 to secure a required clearance 11 between the inclined outer peripheral surface and the outer peripheral surface of the outer tube 1 so as to provide the communication between the front-side communicating portion 3-2 and the front-end opening side of the outer tube 1 through the clearance 11. Further, the annular inclined edge portion 6-1 is formed at the inclined lower end thereof with a liquid stopping flat portion 16 having a suitable annular width so as to enlarge the spacing between the taper portion 6 and the clearance 11 therearound so that adhered ink which flows down from the inclined lower end toward the front-end opening side of the outer tube 1 along the taper portion 6 is prevented from moving toward the clearance 11 side by the liquid stopping flat portion 16. That is, the adhered ink which flows down along the tape portion 6 is dropped from the liquid-stopping flat portion 16 to the front-end opening side of the outer tube 1 to eliminate it from the taper portion 6 (the state indicated by the two-dot chain line in FIG. 3B).

Thus, according to the air-permeable cap of the present invention constructed as described above, during mounting of the body to the axial tube 4, the pen body 5 is guided and led to the inner hole 2-1 of the inner tube 2 while contacting the taper portion 6 (the state of FIG. 3A). Thus, ink adhered to the taper portion 6 flows to the liquid stopping flat portion 16 on the inclined lower end side along the taper portion 6 and drops to the front-end opening side of the outer tube 1 from the liquid stopping flat portion 16 for discharge (the state indicated by the two-dot chain line in FIG. 3B). Accordingly, the ink adhered to the taper portion 6 when the cap is mounted does not flow from the taper portion 6 into the clearance 11 for communication between the front-side communicating portion 3-2 of the air communicating portion 3 and the front-end opening side of the outer tube 1 to close the clearance 11.

The suffocation preventive construction, in which even if a curious child or the like erroneously swallows the cap and it lodges in its throat or bronchus, a flow of air is sufficiently secured to avoid suffocation. The air flow is in the form of a crank having a substantially longitudinal section in which the rear-side communicating portion 3-1 comprising the first and second communicating portions 3-10 and 3-11 opened to the rear end surface of the inner tube 2 and the front-side communicating portion 3-2 communicated with the front-end opening side of the outer tube 1 through the annular clearance 11 around the annular incline edge portion 6-1 provided with the taper portion 6 are communicated through the bent communicating portion 3-3, which is bent at substantially right angles in a peripheral direction. Therefore, even if a curious child or the like should insert an elongated foreign matter or the like from the opening of the first communicating portion 3-10 into the rear-side communicating portion 3-1, when the cap is in the state mounted to or removed from the axial tube 4, it is caught by the bent communicating portion 3-3 for communication between the front-side communicating portion 3-1 and the rear-side communicating portion 3-2. Whereby, the inserted elongated foreign matter does not, completely pass (enter) through the air communicating portion 3 comprising the rear-side communicating portion 3-1 and the front-side communicating portion 3-2 but quickly slips out of the opening of the first communicating portion 3-10 inserted. That is, a suffocation preventive construction is provided with can avoid danger caused by entry of the elongated foreign matter and in which the permeability is not impaired by entry of the elongated foreign matter.

Figure 4:
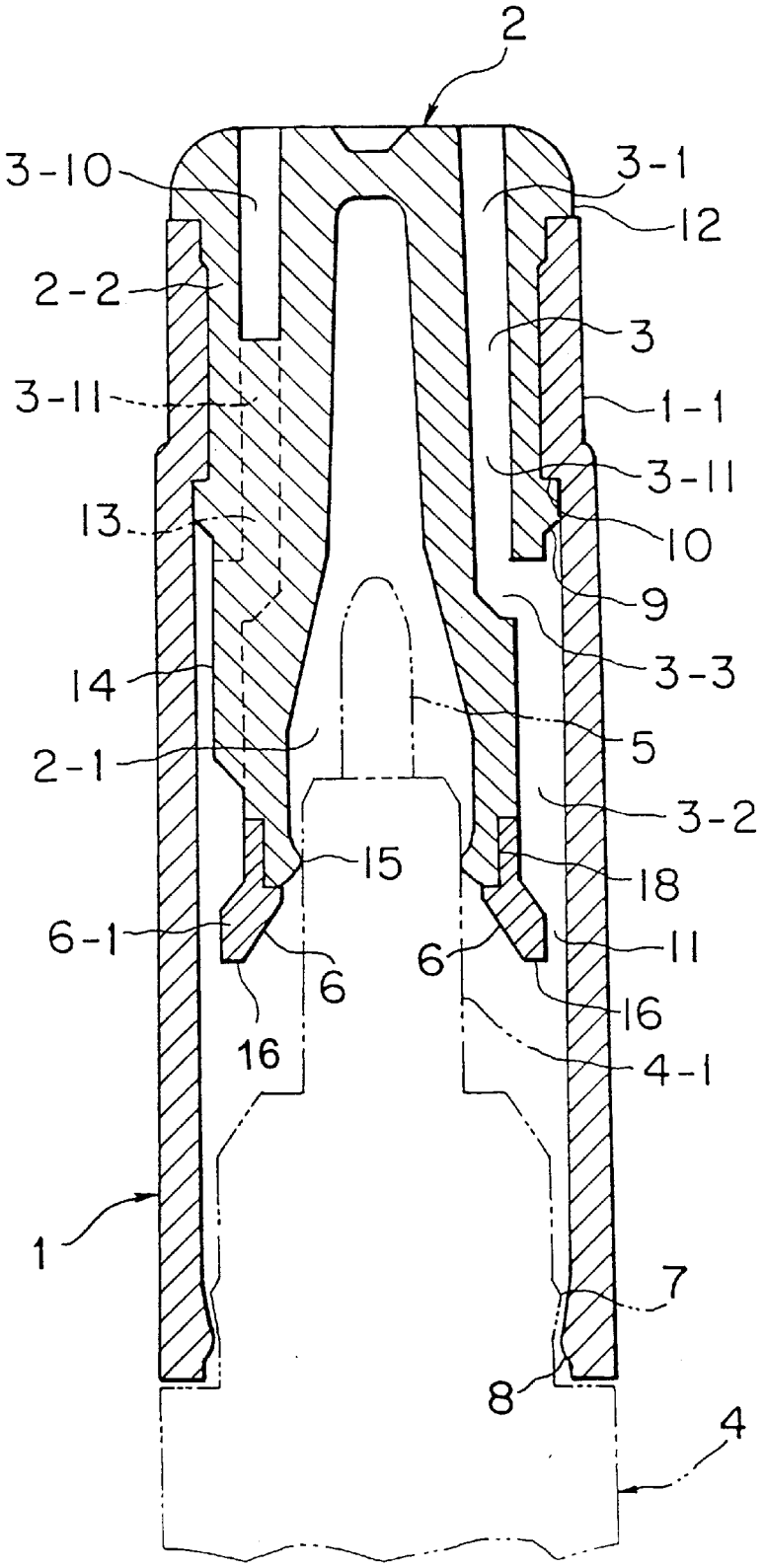
FIG. 4 is a longitudinal sectional view showing another embodiment of the cap for a writing means according to the present invention.

FIG. 4 shows another embodiment in which an annular inclined edge 6-1 provided with a taper portion 6 is formed separately from the inner tube 2 and mounted on the front-end opening of the inner tube 2 by means of a suitable mounting method such as press-fit, screwing or adhesives. This embodiment is fundamentally the same in constitution as that of the embodiment previously described except that the separately formed annular inclined edge 6-1 is mounted on the inner tube 2. Therefore, the same constituent parts are indicated by the same reference numerals and details thereof are omitted. The annular inclined edge 6-1 is molded of the same injection molding material as or different injection molding material from that of the inner tube 2, and mounted on a mounting portion 18 provided on the front-end opening of the inner tube 2 by means of various mounting methods as mentioned above to secure and form a predetermined clearance 11 relative to the inner peripheral surface of the outer tube 1.

The cap for a wiring implement according to the present invention is constructed as described above, and exhibits the operation and effects as follows:

(1) During mounting of the cap to the axial tube, the pen body is guided and led into the inner tube while contacting with the taper portion. Thus, ink adhered to the taper portion flows toward the inclined lower end and drops from the inclined lower end toward the front-end opening side of the outer tube. That is, the clearance secured and formed between the inclined lower end and the inner peripheral surface of the outer tube is not closed by the ink which flows down along the taper portion.

(2) The adhered ink which flows down from the inclined lower end to the front-end opening side of the outer tube along the taper portion is prevented from moving toward the clearance by the provision of the liquid stopping flat portion provided at the inclined lower end of the taper portion. That is, the adhered ink which flows down along the taper portion drops from the liquid stopping flat portion to the front-end opening side of the outer tube and is positively discharged from the taper portion.

(3) Even if a curious child or the like should insert an elongated foreign matter or the like into the air communicating portion when the cap is mounted to or removed from the axial tube, it is caught by the bent communicating portion for peripherally bending and communicating the rear-side communicating portion and the front-side communicating portion. That is, even if a child does mischief such that an elongated foreign matter is inserted into the air communicating portion, it is not completely passed (entered) into the air communicating portion but quickly slips out of the opening of the air communicating portion into which the foreign matter is inserted, thus avoiding a dangerous possibility that the child swallows the elongated foreign matter.

(4) Even if there occurs a dimensional error caused by molding such that the inside diameter of the outer tube is slightly smaller than the outside diameter of the inner tube or the outside diameter of the inner tube is slightly larger than the inside diameter of the outer tube, such a slight dimensional error is absorbed and relieved by the rear-end communicating portion of the air communicating portion provided coaxially and annularly from the closed rear end surface of the inner tube toward the front-end opening side. That is, the inner tube can be incorporated and fitted into the outer tube without applying the load stress (internal stress) caused by the dimensional error such that an unnatural condition occurs when the inner tube is incorporated into the rear-end opening of the outer tube, thus not giving rise to damage such as a crack caused by the load stress to the rear-end opening of the outer tube.

(5) When the inner tube is incorporated as described above, the inner tube is incorporated and fitted into the outer tube till the large-diameter collar portion of the inner tube comes in contact with and stops at the rear-end opening of the outer tube whereby the stopping convex portion of the inner tube is stopped at the stopping shoulder of the outer tube. Thereby, the inner tube is firmly fixedly held in an immovable state in the axial direction by the large-diameter collar portion and the stopping convex portion, and thus, the inner tube will not slip out of the outer tube. For example, the close contact fitting force of the inner tube with respect to the front-portion of the outer tube is so strong that when removing the cap from the axial tube, the inner tube will not slip out of the outer tube.

(6) The elastically deformed state of the inner tube when subjected to slight elastic deformation during the process of being fitted onto the fore-portion of the pen when in contact along the outer peripheral surface of the fore-portion, from which the pen body projects when mounted to the axial tube, can be maintained constant for a long period of time by the longitudinal rib provided on the outer peripheral surface thereof. That is, the lowering of the elastic force of the inner tube which might possibly occur by the repetitious elastic deformation upon every mounting to and removal from the axial tube is prevented by the longitudinal rib on the outer peripheral surface thereof. Thus, the inner tube can be placed in close contact with and fitted in the fore-portion with high air tightness required to prevent volatilization of ink from the sealed pen body.

Accordingly, according to the present invention, in a cap of a double-tube construction in which an air communicating portion is provided between an outer tube having front and rear open portion and a closed-end tubular inner tube, the air communication portion is not closed by ink adhered to the taper portion. Therefore, the permeability as the permeable cap can be maintained positively for a long period of time. Further, since a suffocation preventive construction for inhibiting an entry of an elongated foreign matter is employed, it is possible to provide a cap for a writing implement with further improved safety and reliability as a permeable cap in which danger caused by the entry of an elongated foreign matter can be avoided, and the permeability is not impaired by the entry of an elongated foreign matter.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A cap of a double-tube construction or a writing instrument, said cap comprising:

an outer tube having open rear and front ends;

an inner tube having a closed end and an open end, said inner tube coaxially positioned within said outer tube;

an air communicating portion provided between said outer tube and said inner tube, said air communication portion extending along a length of the inner tube and defining an annular space in the closed end of the inner tube and extending inwardly of the rear end of the outer tube, said inner tube having a tapered portion that guides a writing instrument into the inner tube during mounting of the cap to an axial tube of a writing instrument body, said tapered portion being located at the open end of the inner tube opposite the closed end, said tapered portion being spaced from the axial tube when the cap is mounted on the writing instrument body; and a predetermined clearance connecting said air communicating portion with a front end opening of the outer tube, said predetermined clearance being provided between an inner tapered portion being enlarged and inclined to extend from the open end of the inner tube toward the inner peripheral surface of the outer tube and toward the front end opening of the outer tube.

2. The cap for a writing instrument according to claim 1, wherein a front end of the tapered portion is provided with a liquid stopping flat portion having an annular width that enlarges the predetermined clearance and enable communication between the air communicating portion and the front end opening of the outer tube.

3. The cap for a writing instrument according to claim 1, the air communicating portion having a substantially crank-shaped configuration in longitudinal section, said crank-shaped configuration comprising an annular rear end communicating portion provided coaxially in the inner tube and extending from the closed end of the inner tube for a predetermined distance toward the open end of the inner tube and a front end communicating portion provided between the inner tube and the outer tube frontwardly of the rear end communicating portion, and a peripherally bent portion provided between the rear end communicating portion and the front end communicating portion.

4. The cap for a writing instrument according to claim 3, the inner tube having, at the closed end, an outer peripheral edge with a large-diameter collar portion which contacts and stops at the rear opening of the outer tube, the inner tube having an outer diameter adjacent the rear end communicating portion, such that the large-diameter collar portion is capable of being mounted onto the outer tube.

5. The cap for a writing instrument according to claim 4, wherein a convex stopping portion is provided at an outer peripheral surface of the inner tube spaced from the large-diameter collar portion toward the open end of the inner tube, the outer tube having a stopping shoulder for abutting against said stopping convex portion, said convex stopping portion being positioned along an inner peripheral surface of the outer tube frontwardly of the rear-end opening of the outer tube.

6. A cap for a writing instrument according to claim 1, wherein a plurality of longitudinal ribs are provided on the outer peripheral surface of the inner tube, the plurality of longitudinal ribs extending from a position along the inner tube forwardly of the rear end towards the front end of the inner tube.

7. A cap for a writing instrument according to claim 1, wherein the predetermined clearance defines an annular opening.

8. A cap for a writing instrument according to claim 1, the tapered portion providing for discharge of ink, adhered to the tapered portion during mounting of the cap to the writing instrument body, from the cap and precluding the predetermined clearance from becoming obstructed by accumulated ink.

9. A cap for a writing instrument, said cap comprising:

an outer tube having open front and rear ends;

an inner tube, said inner tube having a closed rear end and an open front end;

the inner and outer tubes being connected by engagement of the rear end of said inner tube with the rear end of the outer tube, such that said inner tube is coaxially positioned within the outer tube, the inner tube including a plurality of ribs extending axially from the inner tube at a position intermediate the front and rear ends of said inner tube, the ribs engaging with an inner peripheral surface of the outer tube to retain the inner tube coaxially with respect to the outer tube;

the inner tube having, at a frontmost end of the inner tube, a tapered portion, the tapered portion extending forwardly from the inner tube and towards the inner peripheral surface of said outer tube, the tapered portion providing an annular air communicating region between an outer periphery of the inner tube and the inner periphery of the outer tube, the tapered portion guiding a writing instrument body into the inner tube when the cap is positioned on the writing implement, the tapered portion being spaced from the body of the writing implement when the cap is mounted on the writing instrument;

an air communication pathway extending from the rear end of the inner tube to the front end of the outer tube when the cap is removed from the writing instrument, the air communication pathway having an annular shape at the rear end of the inner tube and comprising a rear air pathway positioned inwardly of the engagement between the inner tube and the outer tube, and a front air pathway positioned frontwardly of the rear air pathway, said front air pathway being defined between the inner peripheral surface of the outer tube and the outer peripheral surface of the inner tube, and inclined air pathway connecting a front end of said rear air pathway and a rear end of the front air pathway; and an annular clearance being provided at a frontmost end of the front air pathway and connecting the front air pathway with an inner region of the outer tube beyond an axial extent of the inner tube.

10. The cap according to claim 9, the inner tube including an annular structure projecting inwardly from the inner peripheral surface of the inner tube rearwardly of the tapered portion, said annular structure engaging and resiliently and sealingly engaging the body of the writing instrument when the cap is mounted on the writing instrument.

11. The cap according to claim 9, the inner tube having a collar at the closed end rearwardly positioned collar and a stopping portion, an outer peripheral diameter of the inner tube between the collar portion and the stopping portion being reduced with respect to a diameter of the inner tube at the stopping portion and at the collar portion, the outer tube having an axially extending inwardly projecting portion sized to be received between the collar portion and the stopping portion of said inner tube to engage the outer tube with the inner tube.

12. The cap according to claim 9, the tapered portion having, at a lowermost end, a liquid stopping flat portion, an outer extent of the liquid stopping flat defining the annular clearance.

13. The cap according to claim 9, a frontmost end of the outer tube comprising an annular fitting portion shaped to sealingly engage with a corresponding portion of the writing instrument.

* * * * *

UNITED STATES PATENT AND TRADEMARK OFFICE

CERTIFICATE OF CORRECTION

PATENT NO. : 5,927,887

DATED : July 27, 1999

INVENTOR(S) : S. ISHIKAWA et al.

It is certified that error appears in the above-identified patent and that said Letters Patent is hereby corrected as shown below:

At column 9, line 44 (claim 10, line 6) of the printed patent, "or" should be —for—.

At column 9, line 66 (claim 1, line 22) of the printed patent after "inner", —peripheral surface of the outer tube and an inclined lower end of the tapered portion, said tapered portion.— should be inserted.

At column 12, line 19 (claim 12, line 3) of the printed patent, after "flat", —portion— should be inserted.

Signed and Sealed this

Twentieth Day of March, 2001

Nicholas P. Godici

*Attest:*

NICHOLAS P. GODICI

*Attesting Officer*

*Acting Director of the United States Patent and Trademark Office*